US006682313B1

(12) United States Patent
Sulmone

(10) Patent No.: US 6,682,313 B1
(45) Date of Patent: Jan. 27, 2004

(54) COMPRESSED AIR POWERED PUMP PRIMING SYSTEM

(75) Inventor: Michael Sulmone, Collegeville, PA (US)

(73) Assignee: Trident Emergency Products, LLC, Plymouth Meeting, PA (US)

( * ) Notice: Subject to any disclaimer, the term of this patent is extended or adjusted under 35 U.S.C. 154(b) by 0 days.

(21) Appl. No.: 10/006,978

(22) Filed: Dec. 4, 2001

Related U.S. Application Data

(60) Provisional application No. 60/251,002, filed on Dec. 4, 2000.

(51) Int. Cl.[7] ..... F04B 23/08
(52) U.S. Cl. ..... 417/199.2; 417/200
(58) Field of Search ..... 417/199.2, 200, 417/201, 364, 435

(56) References Cited

U.S. PATENT DOCUMENTS 2,897,764 A * 8/1959 Tracy ..... 103/113
3,370,604 A * 2/1968 Napolitano ..... 137/117
3,867,070 A * 2/1975 Sloan ..... 417/34
4,183,721 A * 1/1980 Peterson ..... 417/40
4,515,180 A * 5/1985 Napolitano ..... 137/565
5,536,147 A * 7/1996 Lang ..... 417/199.2
5,660,533 A * 8/1997 Cartwright ..... 417/435

* cited by examiner

*Primary Examiner*—Cheryl J. Tyler
*Assistant Examiner*—Han L Liu
(74) *Attorney, Agent, or Firm*—John F.A. Earley; John F.A. Earley, III; Harding, Earley, Follmer & Frailey

(57) ABSTRACT

A pump primer for a pump on a fire truck uses a high-speed compressed air in a venturi in a compressed air chamber to generate a vacuum in a vacuum chamber to prime a pump, with an integral valve which separates the pump from the priming ejectors (venturis), the valve being opened by the compressed air when the primer is activated, the valve being closed by a spring return when the compressed air supply is removed, where water drawn in through the primer is freely drained by gravity to prevent freezing in cold weather.

16 Claims, 2 Drawing Sheets

COMPRESSED AIR POWERED PUMP PRIMING SYSTEM

CROSS-REFERENCE TO RELATED APPLICATIONS

This utility patent application claims priority of Provisional Patent Application No. 60/251,002 filed Dec. 4, 2000 by Michael Sulmone.

BACKGROUND OF THE INVENTION

Field of the Invention

This invention relates to priming pumps, and more particularly, it relates to the priming of pumps on fire trucks which use centrifugal water pumps as the means to pressurize and propel the water that is used to extinguish fires. Centrifugal pumps of this type used in the fire trucks are not self-priming and rely on a primer to bring the water to the pump. Typically, this involves pumping from a positive pressure source, like a fire hydrant, or using a primer when drafting water from a pond which is located below the pump.

The most common type of priming device used is a separate positive displacement pump, which evacuates the fire pump and suction line until the air is displaced by water. The prior art in this industry uses a sliding vane type pump which is driven by an electric motor. Other devices used include water-ring primer pumps, piston pumps, gear pumps and exhaust gas-ejector pumps. Each of the priming means just mentioned has varying drawbacks in complexity, cost, reliability, speed, ease of use, freezing, electrical current draw, contamination, installation ease, safety, maximum attainable vacuum, or environmental concerns. The invention disclosed herein is an improvement over the current technology used in fire trucks because of its simplicity, high reliability and performance.

SUMMARY OF THE INVENTION

It is an object of this invention to overcome the disadvantages of the prior art and to provide a primer which uses high speed compressed air in a venturi to generate a vacuum to prime a centrifugal pump. It uses compressed air supplied by the air brake compressor of an air-brake fire truck.

This provides for a consistent, highly reliable source of high-pressure air. The high-pressure air flows through a series of venturi (also referred to as ejectors) and is controlled by a valve, which is controlled by either the pump operator or is controlled automatically as part of the entire pumping system. The system is designed with an integral valve that separates the pump from the priming ejectors, and is opened by the compressed air when the primer is activated. The valve closes by a spring return when the air supply is removed. Any water drawn into the primer freely drains by gravity to prevent freezing of the primer in cold weather.

The air valve used is an electric solenoid actuated valve that is tied to a series of switches and sensors that automatically activate the priming system when needed and disengage it when the pump is fully primed. This automatic system may be turned off at the operator's switch or overridden in the "manual" mode of that switch when needed for such operations as inspection and test purposes.

Both figures display all the components of the primer system, as well as a cross-sectional view of the compressed air chamber showing the ejector venturis and showing the integral valve between the compressed air chamber and the vacuum inlet chamber.

DETAILED DESCRIPTION OF THE INVENTION

Figure 1:
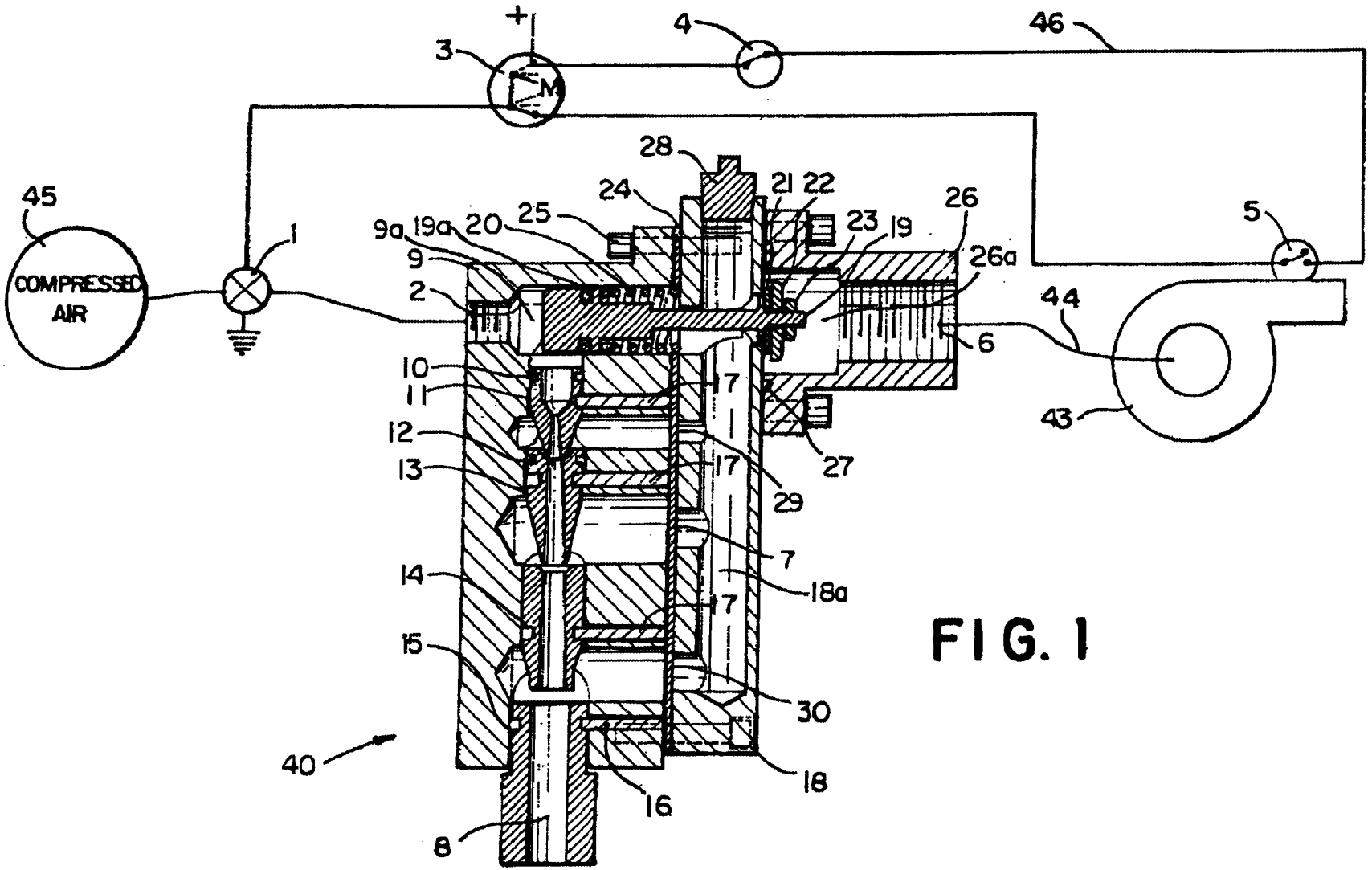
FIG. 1 is a schematic drawing showing the priming system at rest with no compressed air entering the primer and with no vacuum being drawn from the pump.

FIG. 1 shows a primer 40 in a relaxed position where the pump 43 has pressure, which opens the electrical circuit 46 and stops the flow of compressed air from compressed air source 45.

The pump 43 of a fire truck is typically located inside a "pump box" that is mounted in the central part of the fire truck.

The primer 40 is connected to the pump 43 by a vacuum conduit 44. The conduit 44 screws into an inlet adapter 26 of the primer 40. For practical purposes, the conduit 44 may just be a short pipe nipple that also supports the weight of the primer, but the primer 40 may also be remotely mounted with a longer conduit.

Another part of the primer system that is mounted on the pump 43 is the pressure switch 5. It is a normally closed pressure switch which opens the circuit when the pump pressure reaches a pre-set minimum value.

The pressure switch 5 is electrically connected to the pump shift switch 4 which is located on the transfer case that provides power from the vehicle drive shaft to the pump 43. The transfer case is not part of the primer 40, but does provide a place for the primer 40 to sense the position of the shifting mechanism in the transfer case. It is either in "pump" or "road" position. When the transfer case is in road position the pump 43 is disengaged and the drive train to the truck wheels is engaged to enable the truck to move. When the transfer case is in pump position, the road gearing is disengaged and the pump 43 is engaged. The shift switch 4 is closed in the pump position and open in the road position.

The shift switch 4 is electronically connected to the operator's switch 3 which is a three-position switch in which the center position is open. Toggling the switch to one side completes the circuit to enable the primer 40. Toggling the switch the opposite way provides for a momentary contact, which completes the circuit regardless of the position of the shift switch 4 or the pressure switch 5. The switch means described here may also be comprised of several separate switches that serve the same purpose.

The operator's switch 3 is electrically connected to the solenoid valve 1. The solenoid valve 1 is mounted between the compressed air source 45 and the outboard body 9 which forms part of the compressed air chamber 9*a* of the primer 40. The solenoid valve 1 is a normally closed valve that opens when voltage is applied to it. The solenoid valve 1 is coupled to the outboard body 9 either directly or through a pipe nipple which supports the weight of solenoid valve 1 or through any type of conduit with the solenoid valve 1 having alternative mounting means.

The primer 40 also works in a manual mode with a manually operated air valve in place of the solenoid valve 1. In manual mode, none of the electrical wiring is necessary. It is a simplified, lower cost manual priming system with all of the features and components of the entire system minus the automatic mode.

Compressed air from compressed air source 45 enters the compressed air inlet port 2 which is adjacent to the priming valve stem 19 that travels linearly inside the outboard body 9 and compressed air chamber. A series of four components (first stage nozzle 11, second stage nozzle 13, third stage nozzle 14, and third stage venturi 15) are located inside the outboard body 9 in a linear manner. They are approximately sized for the airflow output of the compressed air system of the vehicle. The nozzles and venturi 11, 13, 14, 15 are radially located by a close fit by their outside diameters and the concentric bores in the outboard body 9. They are located axially by close fitting pins 17 and 16 into grooves in the outside diameters of the nozzles and venturi 11, 13, 14, 15. The pins 17 and 16 are located in holes that are in the outboard body 9. The pins 17 and 16 are also captured between the nozzles and venturi 11, 13, 14, 15 and the gasket 24. An O-ring seal 10 separates the high-pressure compressed air from the high vacuum of the first stage 11. There is also another O-ring seal 12 which separates the high vacuum of the first stage 11 and the second stage 13. O-rings were not used on stages other than the first stage 11 due to the lower vacuum and higher flow requirements of the second stage 13 and third stage 14.

A gasket 24 separates the inboard body 18 from the outboard body 9 and seals the porting between them. Cap-screws 25 hold the two bodies together. The gasket 24 also has flaps 7, 29 & 30 cut into it which serve as check valves to prevent air flow from reversing from the lower vacuum second stage 13 and third stage 14 to the higher vacuum first stage 11. The check valve flaps 7 and 30 in the second stage 13 and third stage 14, along with the flap 29 in the first stage 11 also serve to capture the vacuum generated by the priming system during the transition when the priming valve 41 is moving back to it's relaxed position after the compressed air flow is stopped. The plug 28 seals the porting in the inboard body 18 from atmosphere.

The priming valve 41 extends from the outboard body 9 through the inboard body 18 and into the inlet adapter 26. The priming valve 41 is comprised of the valve stem 19, O-ring seal 19*a*, spring 20, valve seal 21, seal washer 22, and nut 23. The function of priming valve 41 is to open when compressed air is in the compressed air inlet port 2 and to close in the absence of compressed air to seal the vacuum of the inlet port 6 and hence the pump 43. It is also designed to seal against high pressure (>500 psi) in the inlet port 6 as well as vacuum. When the valve 41 is closed as shown in FIG. 1, the spring 20 provides the force which biases the valve seal 21 against the face of the inboard body 18 and closes the vacuum path between the inlet chamber 6 and the interior of the inboard body 18. The inlet adapter 26 is attached to the inboard body 18 by cap-screws 25 and sealed from the atmosphere by an O-ring 27. If the primer were integrated as part of the pump 43, the inlet adapter 26 would not be necessary and the inboard body 18 could attach to the suction port of the pump in a similar fashion.

Figure 2:
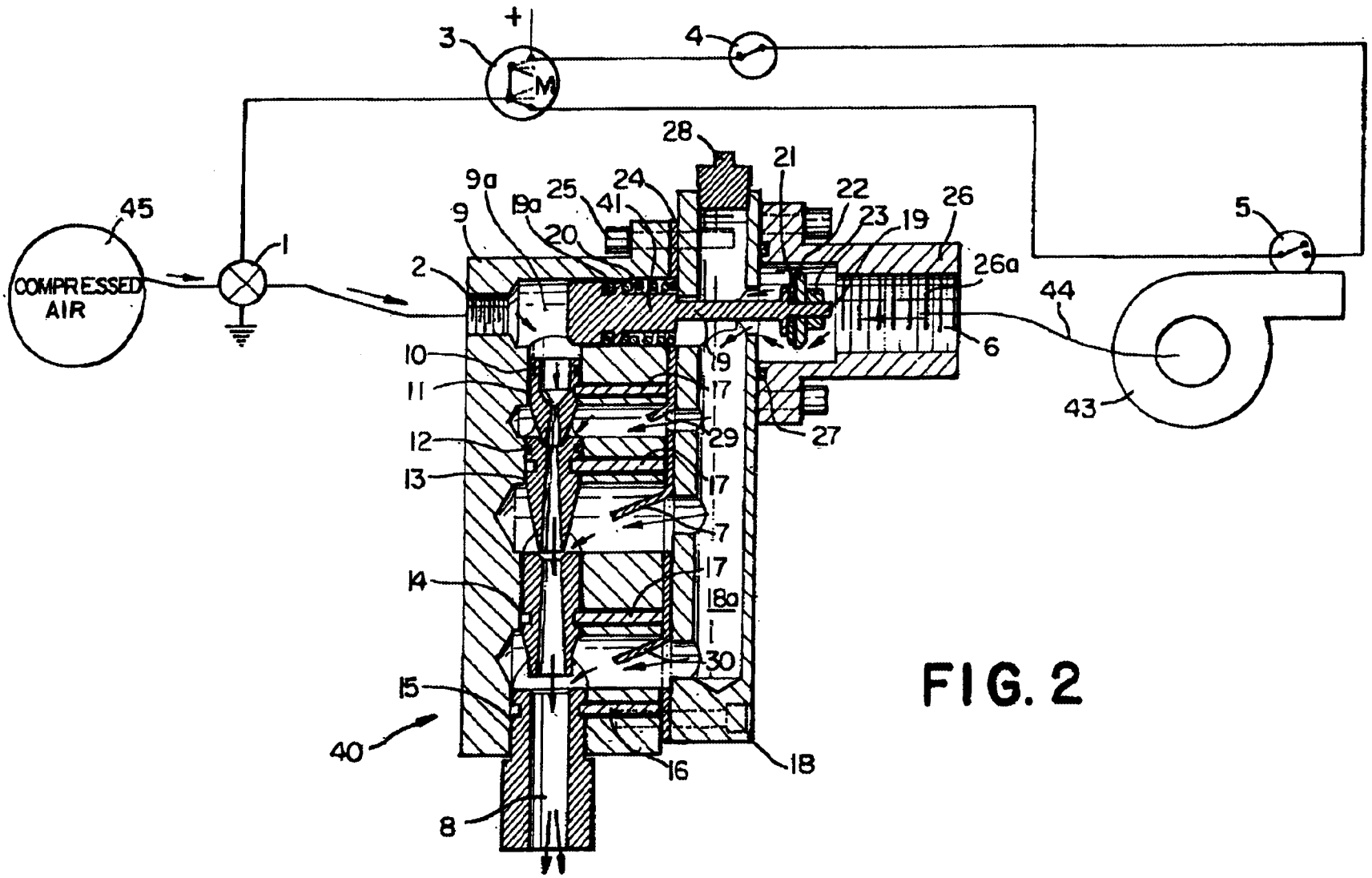
FIG. 2 is a schematic drawing that shows the primer during operation with compressed air being fed to a compressed air chamber in the primer and with the vacuum being drawn from the pump into the vacuum chamber of the primer.

When the primer is mounted in a substantially vertical position as depicted in the FIGS. 1 and 2, the inboard and outboard bodies 18 and 9 will gravity drain any residual water. This precludes any freezing problems.

The materials of construction are all corrosion resistant because of the nature of the service, and are of adequate strength to handle the pressures of the application.

OPERATION

Both FIG. 1 and FIG. 2 are used in this description. FIG. 2 depicts the system during operation and the arrows illustrate the flow paths of the compressed air and the vacuum. FIG. 2 shows the system, as it would be during a priming cycle prior to water entering the pump 43 and building pressure in its discharge. In this position, the normally closed electrical pressure switch 5 is closed. This allows current to flow through it when the pump pressure is below the pre-set minimum value. The pump can only build pressure up to the pre-set value when an adequate prime is established and water is in the centrifugal pump 43. The electrical current is also permitted to flow through the shift switch 4 as the transfer case is in "pump" position. The operator's switch 3 is in the automatic mode, or on position. This completes the circuit from the voltage source to the solenoid valve 1. With the solenoid valve 1 open, compressed air flows into the compressed air inlet 2 where it forces the priming valve 41 to the open position by compressing the spring 20. The compressed air then travels through the center first stage nozzle 11, then through successive lower vacuum nozzles and finally exits at the outlet port 8.

The high velocity of the compressed air causes a pressure depression in the interior porting of the inboard body 18 and outboard body 9, which creates a vacuum flow of air out of the pump 43 to evacuate it. As the compressed air forces open the priming valve 41, it relieves the seal 21 from the sealing surface of the inboard body 18 and opens up a flow path for the vacuum to the pump 43. The evacuated air travels from the pump 43 through a conduit 44 and into the inlet port 6. The evacuating air then travels past the priming valve seal 21 and down the interior porting of the inboard body 18. It then passes through the check valve flaps 7, 29 and 30 and into the flow path of the compressed air where it is expelled to the atmosphere along with the compressed air through the outlet port 8.

Due to the higher vacuum capabilities of the first stage 11 and second stage 13, the vacuum in the interior porting of the inboard body 18 exceeds the maximum attainable vacuum of the third stage 14. At this point, the check valve flap 30 of the third stage 14 closes and the first two stages 11, 13 do all of the further priming. In a similar fashion, the first stage 11 overtakes the second stage 13 and the second stage flap 7 closes, leaving the first stage 11 to continue the evacuation process. Under many circumstances, the pump 43 achieves a prime before the third stage 14 closes. This allows for a very rapid prime under most conditions, which are relatively low lift situations. This is due to the fact that the third stage 14 is designed for high flow and low vacuum, while the first stage 11 is designed for high vacuum and low flow. The second stage 13 is designed for medium vacuum and medium flow.

When the pump 43 is primed, pressure builds in the discharge side of the pump, which opens up the circuit in the pressure switch 5. This removes the voltage from the solenoid-actuated valve 1, which in turn closes the solenoid valve 1 and stops the flow of compressed air. The remaining compressed air in the compressed air inlet port 2 then travels through the nozzles 11, 13, 14 and exits the exit port 8 until atmospheric pressure is equalized in the compressed air inlet port 2. This takes a fraction of a second to happen. As it occurs, the spring 20 returns the integral, air actuated priming valve 41 back to sealed position as shown in FIG. 1. Any water that entered the inboard body 18 or the outboard body 9 runs out of the system due to gravity.

The compressed air-powered pump priming system of the invention used is ejector venturi technology that has an integral, automatically opening and closing priming valve 41.

In this priming system, the priming valve 41 is actuated by compressed air that is used to prime the pump.

In this compressed air-powered pump priming system, when switched to an automatic (on) mode, automatically senses if the pump has a prime and begins to evacuate the pump, if necessary, and cease evacuation when a prime is established.

This pump priming system utilizes the compressed air from an air compressor that is driven by an engine or motor on a fire truck.

This pump priming system utilizes an air compressor that is the one that is used for the air brake system of the fire truck.

This pump priming system only operates in automatic mode when the pump transfer case is in the "pump" position.

This pump priming system has a manual over-ride switch to allow for pump evacuation regardless of pump pressure or transfer case shift position.

This pump priming system automatically gravity-drains any water in the primer after the priming cycle has ended.

This pump priming system automatically drains any water by gravity after the priming cycle has ended.

This pump priming system may be used to prime the main water pump in fire trucks.

This pump priming system for priming the main water pump in fire trucks uses an air-jet ejector.

This pump priming system for priming the main water pump in fire trucks uses an air-jet ejector with a plurality of nozzles or stages.

In this pump priming system, nozzles may be held accurately in their positions with dowel pins located in grooves in the outside diameter of each nozzle.

The compressed air-powered pump priming system comprises a pump 43, a compressed air source 45, a primer 40 having a compressed air chamber 9*a* and a vacuum chamber 18*a*, a hose connecting the compressed air source 45 to the compressed air chamber 9*a*, a connection between the pump 43 and the vacuum chamber 18*a*, a primer valve 41 connected between the vacuum port chamber 26*a* and the vacuum chamber 18*a*, said primer valve 41 has a valve stem 19 connected between the compressed air chamber 9*a* and the vacuum chamber 18*a*. The compressed air in the compressed air chamber 9*a* acts on the valve stem 19 to open the valve 41 between the vacuum port chamber 26*a* and the vacuum chamber 18*a* to draw a vacuum from the pump 43. A series of valves 29, 7, 30 are positioned between the vacuum chamber 18*a* and the compressed air chamber 9*a*, and said series of valves are opened when the valve stem 19 is opened to draw the vacuum and water from the pump 43 into the compressed air chamber 9*a*, and outlet port 8 exhausts the air and any water from the compressed air chamber 9*a*.

The priming system in a fire truck includes a compressed air source 45 and a pump 43, and comprises a primer 40 having a compressed air chamber 9*a* and a vacuum chamber 18*a*, a hose for connecting the compressed air source 45 to the compressed air chamber 9*a*, a hose for connecting the pump 43 to the vacuum chamber 18*a*, a primer valve 41 with a valve stem 19 connected between the compressed air chamber 9*a* and the vacuum chamber 18*a*, a port between the vacuum port chamber 26*a* and the vacuum chamber 18*a*, wherein when said compressed air pushes the valve stem 19 open then the compressed air is accelerated to a high velocity to draw a vacuum from the pump 43 and prime the pump 43, said evacuation air flow opens a series of valves to the compressed air chamber 9*a*.

Said compressed air chamber 9*a* has a series of venturis 11, 13, 14, 15 leading to an outlet port 8 for ejecting the compressed air and any water which may have been drawn into the compressed air chamber 9*a*.

The primer 40 for a pump 43 which is mounted on a fire truck and is adapted to be connected to a source of water like a pond which is below the level of the pump and is not pressurized comprises a pressurized air chamber 9*a* adapted to be connected to a pressurized air source 45, a vacuum port chamber 26*a* adapted to be connected to the pump 43, and a valve 41 which connects the vacuum port chamber 26*a* to the vacuum chamber 18*a*. Outlet port 8 discharges the combined pressure air and vacuum air from the primer 40.

The method of priming a pump 43 on a fire truck comprises the steps of connecting the pump 43 by hose or direct couple to a vacuum chamber 18*a* of a primer 40, connecting a source 45 of compressed air to a compressed air chamber 9*a* of the primer 40, forcing compressed air into the primer compressed air chamber 9*a* and through several venturis 11, 13, 14, 15 in the compressed air chamber, drawing vacuum air from the pump 43 into a vacuum chamber 18*a* in the primer 40, connecting the vacuum in the primer 40 to the compressed air exiting the primer 40 to draw water into the pump 43, sensing when the pump 43 has been primed, shutting off the compressed air to the primer 43, and draining off any water in the primer 40 so as to avoid the water from freezing into ice and blocking the discharge of water from the primer 40 for the next time it is used.

What is claimed:

1. A compressed air-powered pump priming system that uses ejector venturi technology that has an integral, automatically opening and closing priming valve, said system comprising a pump, a primer having a compressed air chamber, a compressed air source communicating with said compressed air chamber, a vacuum chamber communicating with said pump, a plurality of ejector venturi housed in said primer, a priming valve separating the pump from said plurality of ejector venturi, said priming valve being biased to a closed position and being configured to open when a force of compressed air engages with said valve.

2. The priming system as described in claim 1, whereby the priming valve is actuated by the compressed air that is used to prime the pump.

3. The priming system as described in claim 2, further comprising a pump transfer case and a shift switch, said transfer case being positionable in a first position where the transfer case is disengaged from the pump and in a second position where the transfer case engages the pump said shift switch being associated with said transfer case to remain closed when the transfer case is in the first position and remain open when the transfer case is in the second position.

4. The priming system as described in claim 2, comprising a transfer case being positionable in a first position where the transfer case is disengaged from the pump and in a second position where the transfer case engages the pump, and having a manual over-ride switch to allow for pump evacuation regardless of pump pressure or transfer case position.

5. The priming system of claim 4, having a plurality of venturi communicating with an outlet port for facilitating drainage of water from said compressed air chamber after the priming cycle has ended.

6. The priming system of claim 1, having a pressure switch for automatically sensing if the pump has a prime and begin to evacuate the pump if necessary and cease evacuation when a prime is established.

7. The priming system of claim 1, wherein the compressed air source comprises an air compressor that is driven by an engine or motor.

8. The priming system as described in claim 7, whereby the air compressor comprises a vehicle air brake compressor.

9. The priming system of claim 1, having a plurality of venturi communicating with an outlet port for facilitating drainage of water from said compressed air chamber after the priming cycle has ended.

10. The priming system of claim 1 for use with a fire truck having a main water pump, wherein said priming system comprises a priming system for priming the main water pump of a fire truck.

11. The compressed air pump priming system of claim 1 for use with a fire truck having a main water pump, wherein said priming system comprises a priming system for priming the main water pump of a fire truck, and wherein said priming system has an air ejector with plurality of nozzles.

12. A compressed air pump priming system comprising:

a pump, a compressed air source, a primer having a compressed air chamber, a vacuum port chamber and a vacuum chamber, hose means connecting the compressed air source to the compressed air chamber, means connecting the pump to the vacuum chamber, a primer valve connected between the vacuum port chamber and the vacuum chamber, said primer valve having a valve stem connected between the compressed air chamber and the vacuum chamber, said compressed air in the compressed air chamber acting on the valve stem to open the valve between the vacuum port chamber and the vacuum chamber to draw a vacuum from the pump, a series of valves between the vacuum chamber and the compressed air chamber, said series of valves being opened when the valve stem is opened to draw the vacuum air and/or water, from the pump into the compressed air chamber, and exit means to exhaust the air and water from the compressed air chamber.

13. A primer for a priming system in a fire truck which includes a compressed air source and a pump, comprising a primer having a compressed air chamber, a vacuum port chamber and a vacuum chamber, means for connecting the compressed air source to the compressed air chamber, means for connecting the pump to the vacuum chamber, a primer valve with a valve stem connected between the compressed air chamber and the vacuum chamber, a port between the vacuum port chamber and the vacuum chamber, wherein when said compressed air pushes the valve stem open and then the compressed air is accelerated to a high velocity to draw a vacuum from the pump and prime the pump, said evacuation air flow in the vacuum chamber opening a series of valves to the compressed air chamber, said compressed air chamber having a series of venturis leading to an outlet port for ejecting the compressed air and water which may have been drawn into the compressed air chamber.

14. A primer for a pump which is mounted on a fire truck and is adapted to be connected to a source of water like a pond which is below the pump and is not pressurized comprising:

a primer with a vacuum air chamber and a pressurized air chamber adapted to be connected to a pressurized air source, a vacuum port chamber adapted to be connected to a pump, valve means connecting the vacuum air from the vacuum port chamber to the air in the vacuum air chamber, means for discharging the combined pressure air and vacuum air from the primer, valve means connecting the pressurized air to the primer vacuum air chamber, valve means connecting the vacuum air from the pump to the primer, valve means between the vacuum chamber and the vacuum port chamber to bring the vacuum from the vacuum chamber into the vacuum port chamber.

15. A method of priming a pump on a fire truck comprising the steps of connecting the pump by hose or direct couple to a vacuum chamber of a primer, connecting a source of compressed air to a compressed air chamber of the primer, forcing compressed air into the primer compressed air chamber and through several venturis in the compressed air chamber, drawing vacuum air from the pump into a vacuum chamber in the primer, connecting the vacuum in the primer to the compressed air exiting the primer to draw water into the pump, sensing when the pump has been primed, shutting off the compressed air to the primer, draining off any water in the primer so as to avoid the water from freezing into ice and blocking the discharge of water from the primer.

16. A compressed air-powered pump priming system that uses ejector venturi technology that has an integral, automatically opening and closing priming valve, the system comprising a body, a plurality of ejector venturi housed in said body, a priming valve separating the flow from the pump from said plurality of ejector venturi, said priming valve being biased to a closed position and being configured to open when a force of compressed air engages with said valve.

* * * * *